US009692105B2

(12) United States Patent
Watanabe et al.

(10) Patent No.: US 9,692,105 B2
(45) Date of Patent: Jun. 27, 2017

(54) INFORMATION PROCESSING APPARATUS

(71) Applicant: PANASONIC CORPORATION, Kadoma-shi, Osaka (JP)

(72) Inventors: Kouji Watanabe, Osaka (JP); Yasuharu Matsuoka, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 39 days.

(21) Appl. No.: 14/445,811

(22) Filed: Jul. 29, 2014

(65) Prior Publication Data

US 2015/0054691 A1 Feb. 26, 2015

(30) Foreign Application Priority Data

Aug. 23, 2013 (JP) ..... 2013-173181
Jul. 2, 2014 (JP) ..... 2014-136522

(51) Int. Cl.
*H01Q 1/22* (2006.01)
*H01Q 21/30* (2006.01)
*H01Q 21/28* (2006.01)

(52) U.S. Cl.
CPC ..... *H01Q 1/2266* (2013.01); *H01Q 21/28* (2013.01); *H01Q 21/30* (2013.01)

(58) Field of Classification Search
CPC ..... H01Q 1/2266; H01Q 21/30
USPC ..... 343/702, 720, 725, 893
See application file for complete search history.

(56) References Cited

U.S. PATENT DOCUMENTS 7,079,079 B2 * 7/2006 Jo ..... H01Q 1/243 343/700 MS
8,144,072 B2 * 3/2012 Chiang ..... H01Q 1/2266 343/700 MS
9,122,446 B2 * 9/2015 Jervis ..... G06F 1/1616
2004/0174306 A1 9/2004 Katoh et al.
2005/0104788 A1 * 5/2005 Hung ..... H01Q 1/22 343/702

(Continued)

FOREIGN PATENT DOCUMENTS

JP 6-334420 12/1994
JP 2004-266681 9/2004
JP 2006-166225 6/2006

(Continued)

*Primary Examiner* — Dameon E Levi
*Assistant Examiner* — Hasan Islam
(74) *Attorney, Agent, or Firm* — Hamre, Schumann, Mueller & Larson, P.C.

(57) ABSTRACT

There is provided an information processing apparatus in which an antenna operating in two or more communication bands is disposed in a space conserving manner. An information processing apparatus according to the present disclosure has: a network interface for processing signals used for communications in a plurality of frequency bands; a display panel having a main surface for displaying an image, a rear surface opposite to the main surface, and a side surface defining a thickness between the main surface and the rear surface; an antenna connected to the network interface and having a conductive antenna element; and a conductive rib conducted to the antenna element, and holding the antenna with a predetermined gap between the antenna and the side surface of the display panel. The network interface processes the signals by resonance of a part of the antenna element and a part of the rib.

6 Claims, 8 Drawing Sheets

(56) References Cited

U.S. PATENT DOCUMENTS

2012/0299785 A1 11/2012 Bevelacqua

FOREIGN PATENT DOCUMENTS

| | | |
|---|---|---|
| JP | 2007-281906 | 10/2007 |
| JP | 2009-058916 | 3/2009 |
| JP | 2012-249281 | 12/2012 |

* cited by examiner

INFORMATION PROCESSING APPARATUS

BACKGROUND OF THE INVENTION

1. Field of the Invention

The present disclosure relates to an information processing apparatus with an antenna.

2. Description of the Related Art

Unexamined Japanese Patent Publication No. 2012-249281 discloses an antenna which is operable in two or more different antenna modes in different communication bands, respectively. This antenna is configured to operate as an inverted-F antenna in a first operation mode, and to operate as a slot antenna in a second operation mode. With this configuration, it is possible to support a plurality of antenna modes.

SUMMARY OF THE INVENTION

The present disclosure provides an information processing apparatus in which an antenna operable in two or more communication bands is disposed in a space conserving manner.

An information processing apparatus according to the present disclosure comprises: a network interface for processing signals used for communications in a plurality of frequency bands; a display panel having a main surface for displaying an image, a rear surface opposite to the main surface, and a side surface defining a thickness between the main surface and the rear surface; an antenna connected to the network interface and having a conductive antenna element; and a conductive rib conducted to the antenna element, and holding the antenna with a predetermined gap between the antenna and the side surface of the display panel, wherein the network interface processes the signals by resonance of a part of the antenna element and a part of the rib.

The information processing apparatus according to the present disclosure can realize an antenna which is operable in two or more communication bands in a space conserving manner.

DETAILED DESCRIPTION OF THE PREFERRED EMBODIMENT

Hereinafter, an exemplary embodiment will be described with reference to the accompanying drawings as appropriate. However, unnecessarily detailed description may occasionally be omitted. For example, detailed description of well-known matters and redundant description of substantially the same configurations may occasionally be omitted. This is to avoid the following description from becoming unnecessarily redundant, and to ease understanding of those skilled in the art.

Also, the following description and the accompanying drawings are provided to allow any person skilled in the art to fully understand the present disclosure, and do not intend to limit the subject matter described in the claims.

Exemplary Embodiment

Hereinafter, an exemplary embodiment will be described with reference to FIGS. 1 to 8.

1-1. Configuration of Information Processing Apparatus

Figure 1:
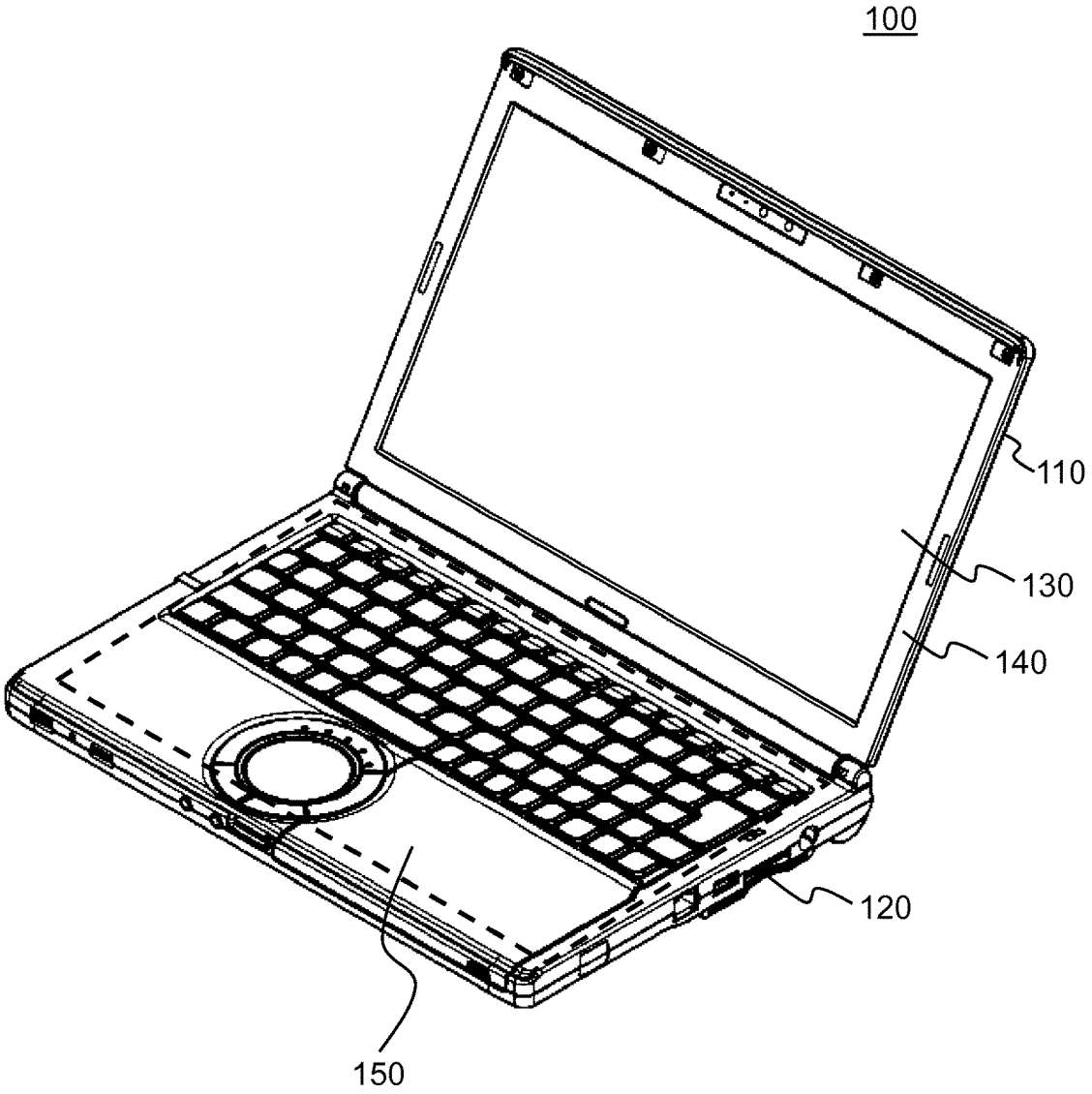
FIG. 1 is a configuration view of an information processing apparatus according to an exemplary embodiment.

FIG. 1 is a configuration view of information processing apparatus 100 according to an exemplary embodiment. In this exemplary embodiment, a notebook computer will be described as an example of information processing apparatus 100. However, information processing apparatus 100 of the present disclosure is not limited to the notebook computer. Information processing apparatus 100 can be applied to a laptop computer, a tablet computer, a smartphone, or the like.

Information processing apparatus 100 is configured by upper housing 110 and lower housing 120. Upper housing 110 has display panel 130 and front cover 140. Lower housing 120 has input device 150 such, for example, as a keyboard and a touch-pad.

Information processing apparatus 100 performs predetermined information processing based on an OS (operating system).

Display panel 130 displays an image and a video. A liquid crystal display is typically used as display panel 130. Display panel 130 is held by being sandwiched between front cover 140 and an unshown rear cover disposed at a side opposite to front cover 140. The front cover 140 side of upper housing 110 is defined as a main surface, and the rear cover side is defined as a rear surface.

Input device 150 accepts an input. Input device 150 to be typically used is a touch panel, a keyboard, a touch-pad, a button, or the like.

Figure 2:
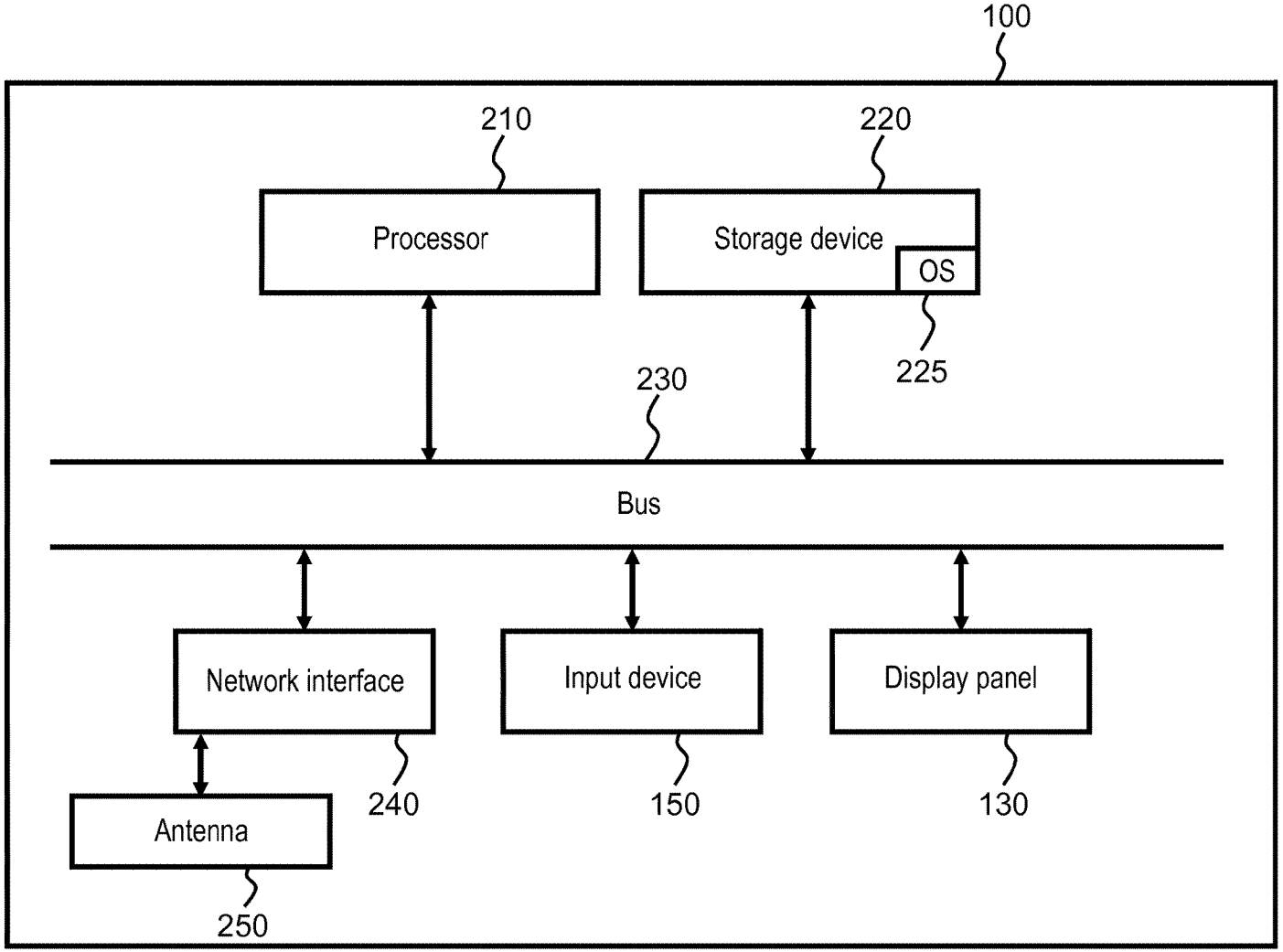
FIG. 2 is a block diagram of the information processing apparatus according to the exemplary embodiment.

FIG. 2 is a block diagram of information processing apparatus 100 according to the exemplary embodiment.

Processor 210 executes a program stored in storage device 220. Processor 210 controls other components of information processing apparatus 100 by executing a program. For example, processor 210 displays an image data stored in storage device 220 on display panel 130.

Storage device 220 temporarily or permanently stores data necessary for information processing apparatus 100 to perform processing. For example, storage device 220 stores OS 225, programs, data bases, and the like. Storage device 220 to be used is a volatile memory, a non-volatile memory, an HDD (hard disk drive), or the like.

Bus 230 is a part through which electric signals sent from and/or to be received by other components of information processing apparatus 100 are transmitted. Control signals or data are transmitted between some components of information processing apparatus 100 through bus 230.

Network interface 240 performs connection to or disconnection from a network, and acquires information about a network. Network interface 240 is controlled by processor 210. Network interface 240 processes signals used for communications in predetermined frequency bands. In the exemplary embodiment, such an example will be described that network interface 240 performs communications in, as the predetermined frequency bands, the 2.4 GHz band, which is used in IEEE 802.11b/g/n, a wireless local area network (LAN) standard, and the 5 GHz band, which is used in IEEE 802.11ac/a/n, another wireless LAN standard. Network interface 240 is connected to antenna 250.

Antenna 250 has a conductive antenna element which will be described later. A signal processed by network interface 240 causes resonance of a part of the antenna element to effect communication.

1-2. Configuration of Antenna

Figure 3B:
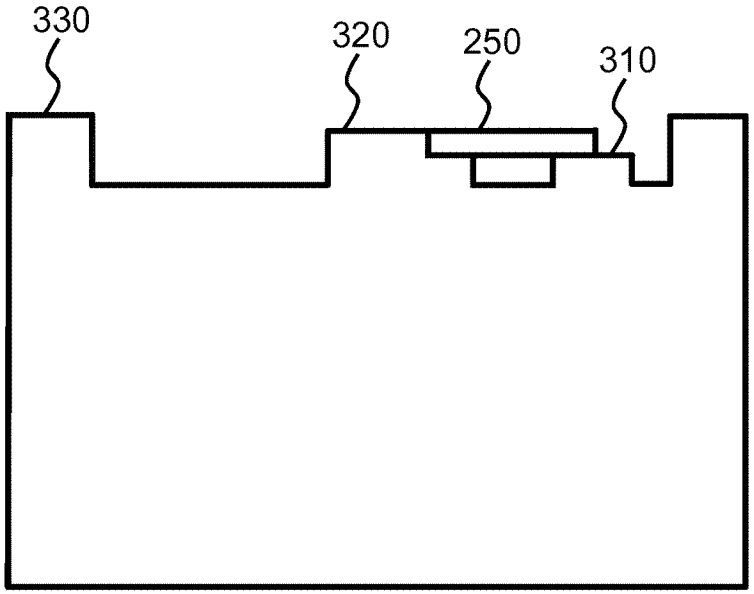
FIG. 3B is a view showing the configuration example of the antenna of the information processing apparatus according to the exemplary embodiment, viewed from a rear surface side of the display panel.
Figure 3A:
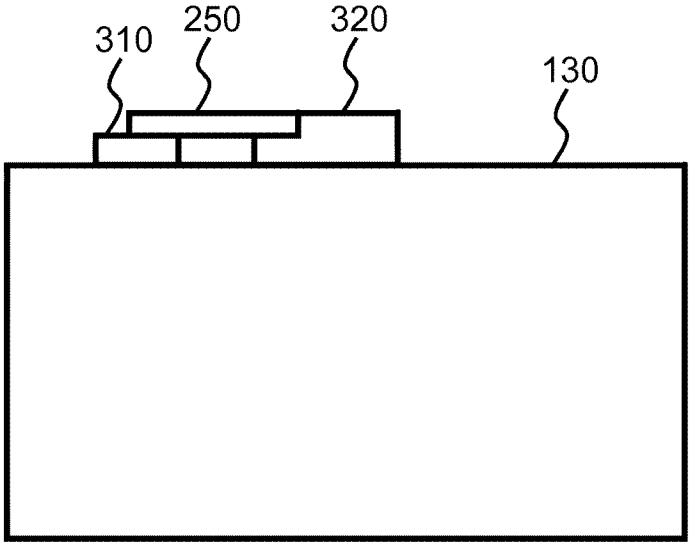
FIG. 3A is a view showing a configuration example of an antenna of the information processing apparatus according to the exemplary embodiment, viewed from a main surface side of a display panel.

FIG. 3A is a view showing a configuration example of antenna 250 of information processing apparatus 100 according to the exemplary embodiment, viewed from the main surface side of display panel 130. FIG. 3B is a view showing the configuration example of antenna 250 of information processing apparatus 100 according to the exemplary embodiment, viewed from the rear surface side of display panel 130.

Front cover 140 and the rear cover are not shown in FIG. 3A. Front cover 140 and display panel 130 are not shown in FIG. 3B.

First rib 310 and second rib 320 are disposed on a top of display panel 130. First rib 310 and second rib 320 are formed integrally with rear cover 330. Rear cover 330, first rib 310 and second rib 320 are made of magnesium, which is a conductor. Rear cover 330, first rib 310 and second rib 320 are integrally formed by molding.

However, first rib 310 and second rib 320 may not necessarily be formed integrally with rear cover 330, and may be formed integrally with front cover 140, or may be formed integrally with a frame or the like of display panel 130.

An end of antenna 250 is held on first rib 310, and the other end of antenna 250 is held on second rib 320. Antenna 250 and first rib 310 are fixed to each other with a screw, which is a conductive fixing member.

Rear cover 330 is connected to an unshown terminal having a ground potential of a voltage for driving information processing apparatus 100.

Figure 4:
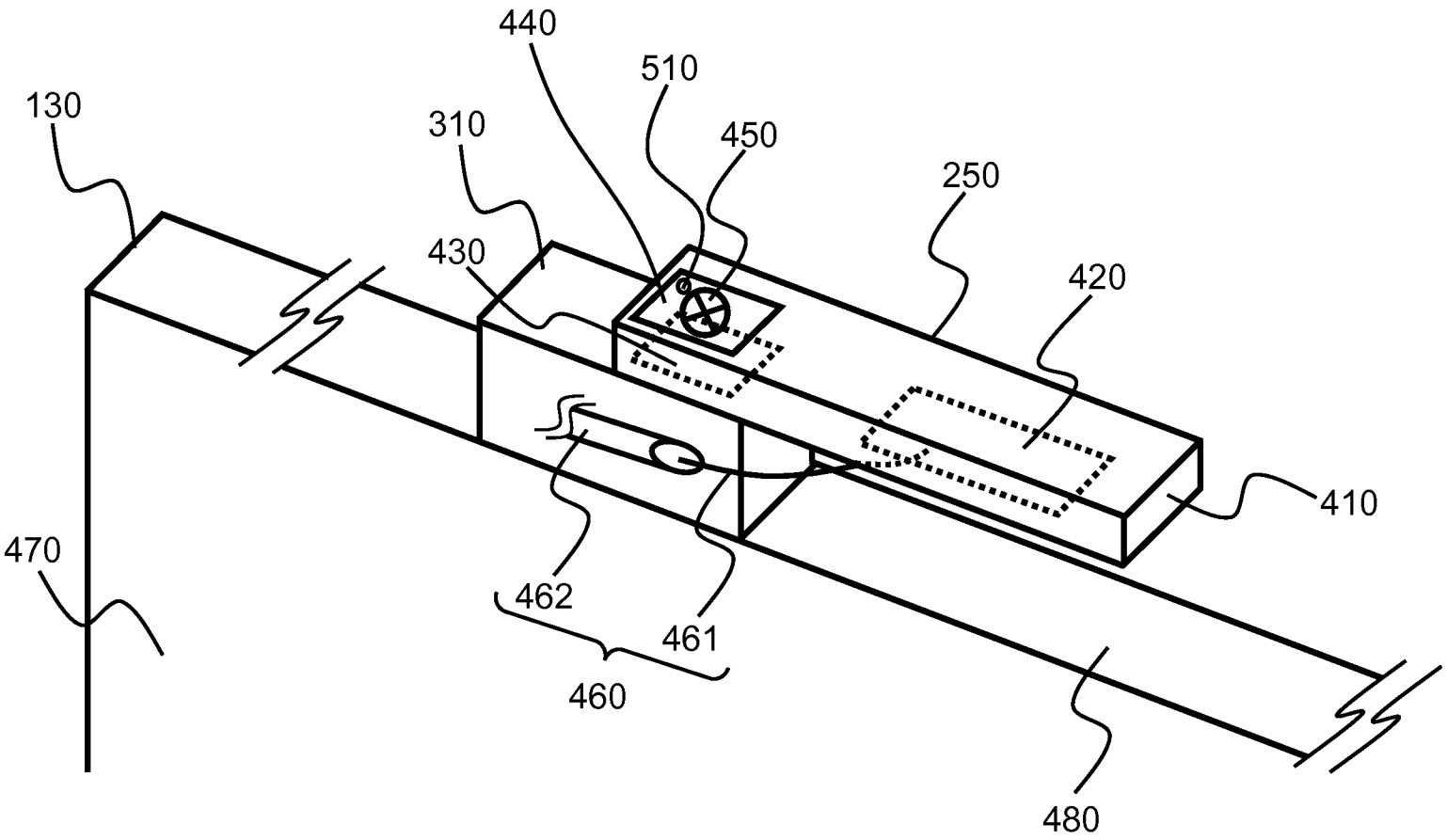
FIG. 4 is a view showing in detail a connection of the antenna and a first rib of the information processing apparatus according to the exemplary embodiment.
Figure 5A:
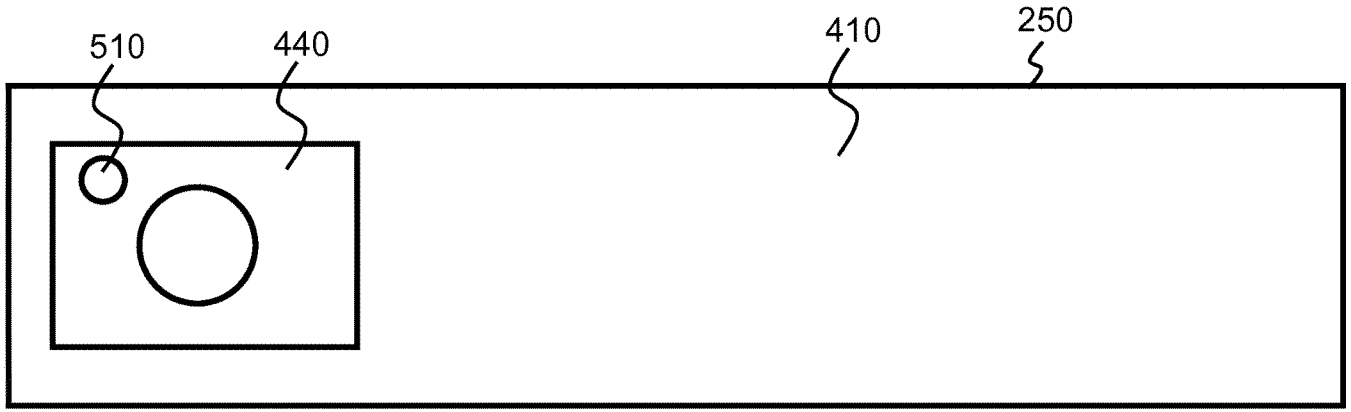
FIG. 5A is a top view of the antenna of the information processing apparatus according to the exemplary embodiment.
Figure 5B:
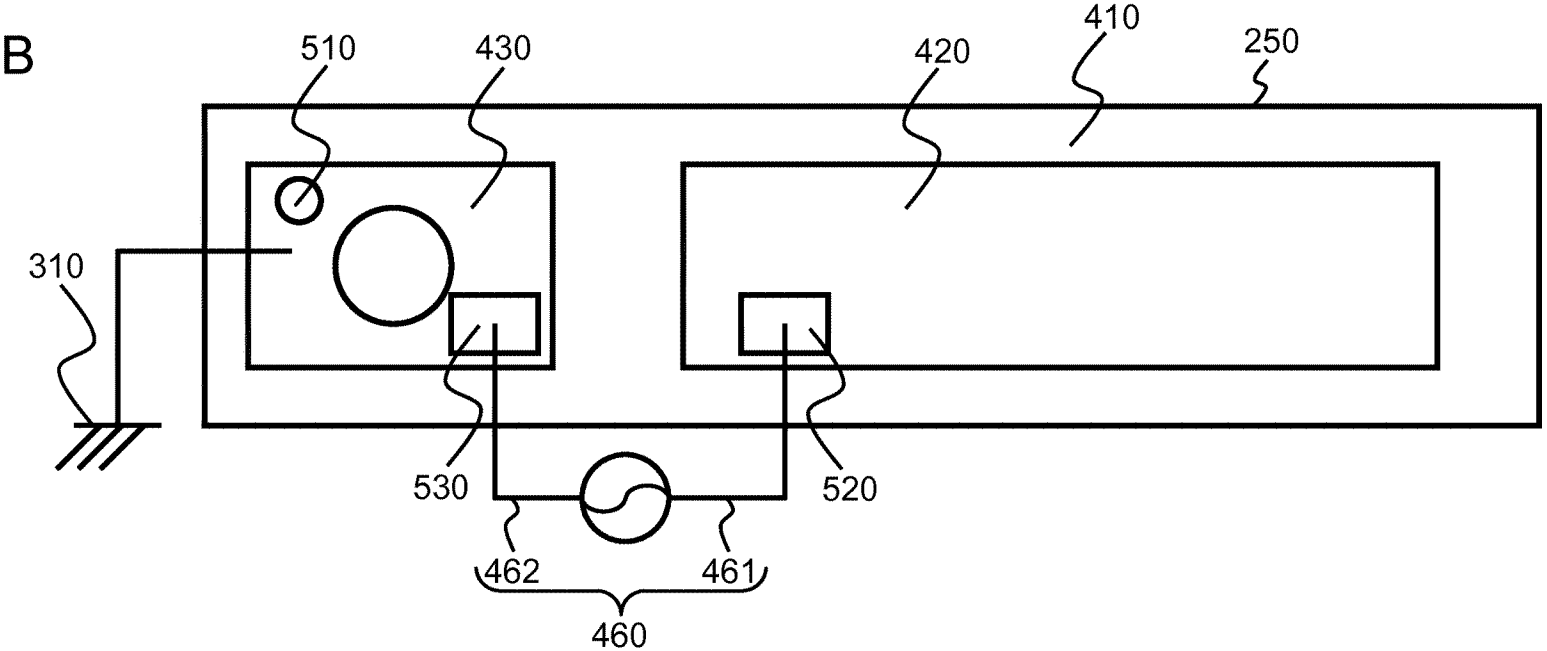
FIG. 5B is a bottom view of the antenna of the information processing apparatus according to the exemplary embodiment.

FIG. 4 is a view showing in detail a connection of antenna 250 and first rib 310 of information processing apparatus 100 according to the exemplary embodiment. FIG. 5A is a top view of antenna 250 of information processing apparatus 100 according to the exemplary embodiment. FIG. 5B is a bottom view of antenna 250 of information processing apparatus 100 according to the exemplary embodiment.

Antenna 250 has dielectric portion 410, first antenna element 420, second antenna element 430, third antenna element 440, and at least one or more through-hole conductors 510. Dielectric portion 410 is an epoxy substrate.

First antenna element 420 is a radiation element made of copper printed on dielectric portion 410 on a lower surface of antenna 250. First antenna element 420 is connected to inner conductor 461 of coaxial cable 460 to form feeding point 520. A voltage is applied to inner conductor 461 of coaxial cable 460. Outer conductor 462 of coaxial cable 460 is connected to the ground of information processing apparatus 100. In FIG. 4, illustration of the outer conductor 462 side of coaxial cable 460 is omitted by break lines.

Second antenna element 430 is a grounding conductor made of copper printed on a rear surface of dielectric portion 410. Second antenna element 430 is electrically connected to outer conductor 462 of coaxial cable 460 to form grounding point 530. Supply of power to antenna 250 becomes possible by connecting antenna 250 to coaxial cable 460.

Third antenna element 440 is a grounding conductor made of copper printed on an upper surface of dielectric portion 410. Third antenna element 440 is electrically connected to second antenna element 430 via through-hole conductor 510.

Antenna 250 is fixed to first rib 310 with screw 450, which is a conductive fixing member. Screw 450 comes in contact with third antenna element 440. Second antenna element 430 comes in contact with first rib 310. Consequently, screw 450, third antenna element 440 and second antenna element 430 are electrically connected. First rib 310 is connected to the ground potential of information processing apparatus 100.

Second rib 320, illustration of which is omitted in FIG. 4, is not electrically connected to antenna 250, but is formed to hold the position of antenna 250.

Display panel 130 has main surface 470 for displaying an image, a rear surface opposite to main surface 470, and side surface 480 defining a thickness of display panel 130. The rear surface is not shown in FIG. 4.

Since antenna 250 is held by first rib 310 and second rib 320, which are disposed on side surface 480 of display panel 130, a predetermined gap is formed between antenna 250 and side surface 480 of display panel 130. Each of first antenna element 420, second antenna element 430 and third antenna element 440 is disposed so as to face in substantially parallel to side surface 480.

In FIG. 5B, inner conductor 461 and outer conductor 462 of coaxial cable 460 as well as first rib 310 are illustrated, not by structural representation, but by electric circuit representation for convenience.

In the exemplary embodiment, first antenna element 420 is made to have a length of 14 mm and a width of 4.3 mm in its longitudinal direction, and first rib 310 is made to have a length of 10 mm and a width of 4 mm in its height direction.

1.3. Operations

Figure 6:
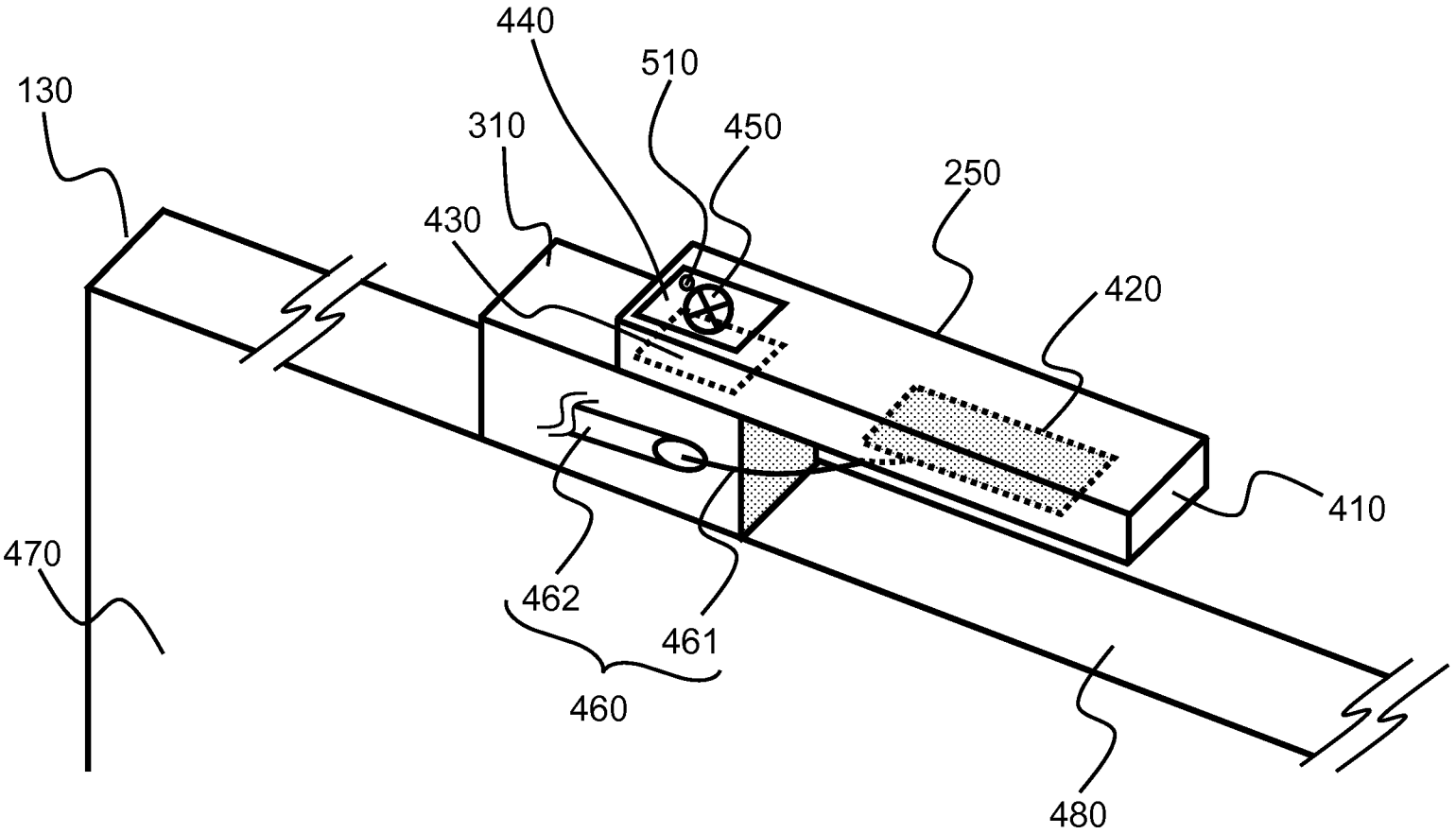
FIG. 6 is a view showing a current distribution on the antenna according to the exemplary embodiment in response to a radio wave in the 2.45 GHz band.

FIG. 6 is a view showing a current distribution on antenna 250 according to the exemplary embodiment in response to a radio wave in the 2.45 GHz band. FIG. 6 is a view obtained by adding a current distribution to FIG. 4. The current distribution shown in FIG. 6 corresponds to the 2.4 GHz band used in IEEE 802.11b/g/n, a wireless LAN standard. The state in which currents are distributed is called "resonance".

Referring to FIG. 6, the portion painted gray is an area where current of 5 A/m or more has flown. More specifically, it can be seen that current of 5 A/m or more has flown through first antenna element 420 and first rib 310. This is because the total length of first antenna element 420 and first rib 310 causes resonance at 2.45 GHz. It is generally known that a length of an antenna suitable to a frequency λ is λ/2 or λ/4. A theoretical value of the antenna length preferable to process a radio wave having a frequency of 2.45 GHz is 30.6 mm. The total length obtained by adding the length 14 mm of first antenna element 420 in its longitudinal direction and the length 10 mm of first rib 310 in its height direction is 24 mm, which is approximately close to λ/4. The difference between the theoretical value and the antenna length applied in the exemplary embodiment can be explained by the wavelength shortening. The wavelength shortening is a phenomenon that the wavelength of a radio wave becomes shorter when the radio wave propagates on a substrate than when the radio wave propagates through air. In the exemplary embodiment, it can be thought that the wavelength shortening would occur when the radio wave propagates on dielectric portion 410. Accordingly, a truly preferable antenna length is shorter than a theoretical value.

Figure 7:
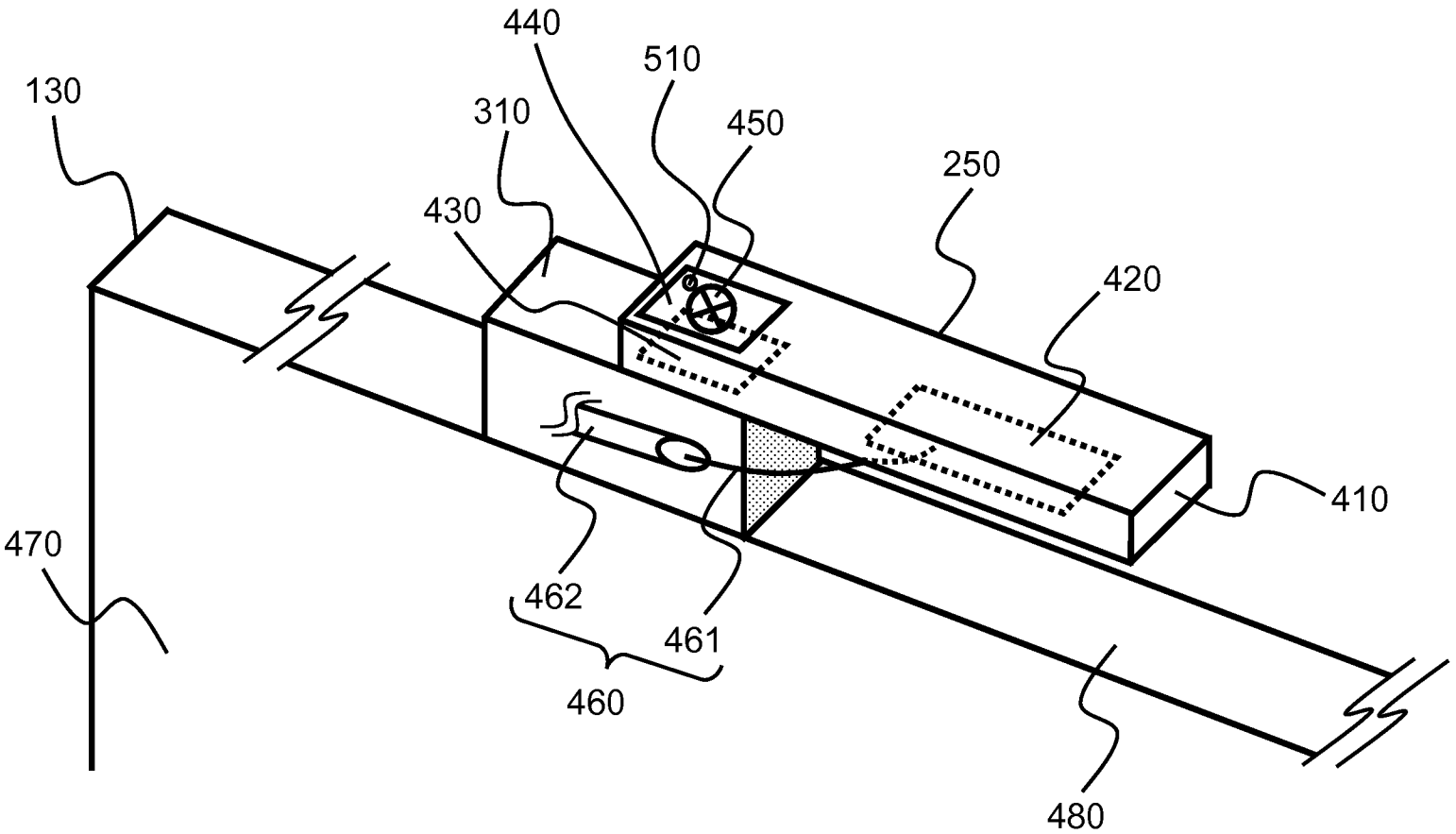
FIG. 7 is a view showing a current distribution on the antenna according to the exemplary embodiment in response to a radio wave in the 5.50 GHz band.

FIG. 7 is a view showing a current distribution on antenna 250 according to the exemplary embodiment in response to a radio wave in the 5.50 GHz band. FIG. 7 is a view obtained by adding a current distribution to FIG. 4. The current distribution shown in FIG. 7 corresponds to the 5 GHz band used in IEEE 802.11ac/a/n, another wireless LAN standard.

Referring to FIG. 7, the portion painted gray is an area where current of 5 A/m or more has flown. More specifically, current of 5 A/m or more has flown through first rib 310. Compared to the case in the 2.45 GHz band, a large quantity of current has not flown through first antenna element 420. This is because the length of first rib 310 causes resonance at 5.50 GHz.

Figure 8:
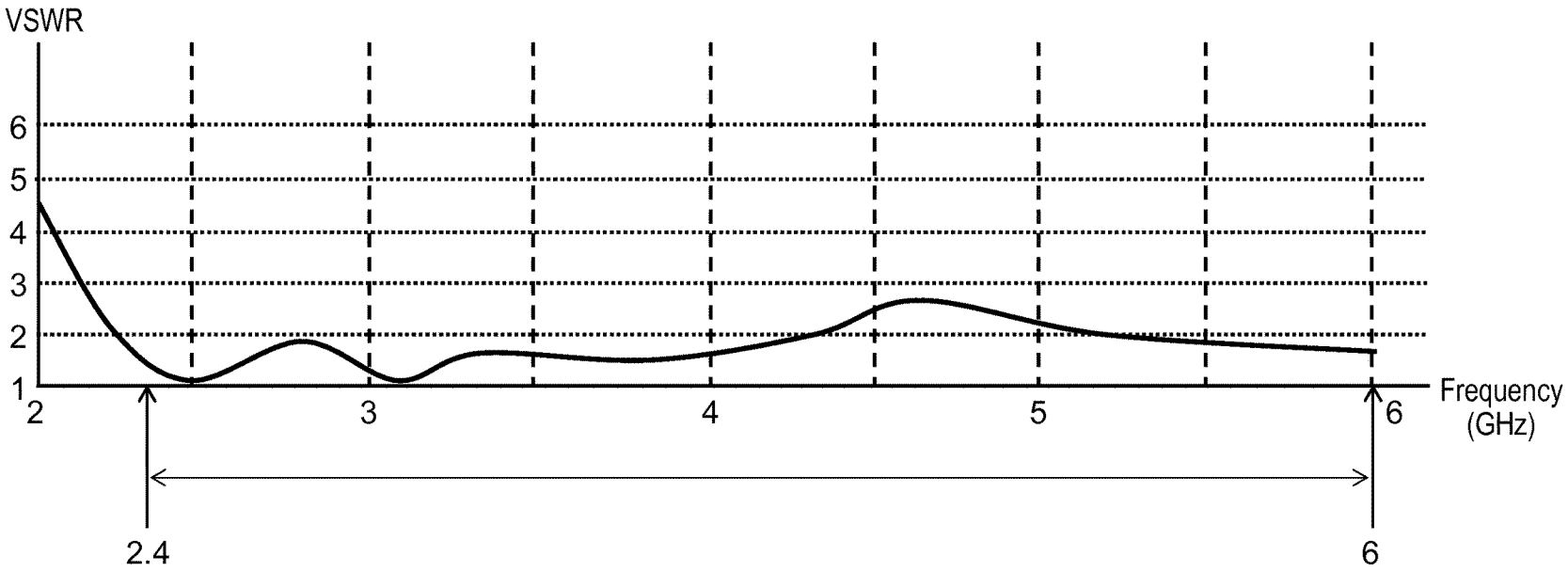
FIG. 8 is a diagram showing a voltage standing wave ratio (VSWR) characteristic of the antenna according to the exemplary embodiment in each frequency band.

FIG. 8 is a diagram showing a voltage standing wave ratio (VSWR) characteristic of antenna 250 according to the exemplary embodiment in each frequency band. The vertical axis represents VSWR, and the horizontal axis represents frequency. A smaller value of VSWR reflects a better antenna characteristic. In general, a preferable value of VSWR is 3 or less.

As shown in FIG. 8, the antenna according to the exemplary embodiment shows a preferable receiving characteristic over a range from 2.4 GHz to 6.0 GHz. First antenna element 420 and first rib 310 as a whole resonate to act as a large radiation element, which can cover wideband characteristics.

1-4. Advantageous Effects

As described above, according to the exemplary embodiment, information processing apparatus 100 is configured by: network interface 240 for processing signals used for communications in a plurality of frequency bands; display panel 130 having a main surface for displaying an image, a rear surface opposite to the main surface, and a side surface defining a thickness between the main surface and the rear surface; antenna 250 connected to network interface 240 and having a conductive antenna element; and conductive first rib 310 conducted to the antenna element and holding antenna 250 with a predetermined gap between the antenna and the side surface of display panel 130. Further, network interface 240 processes the signals by resonance of a part of the antenna element and a part of first rib 310.

With this configuration, by utilizing first rib 310, which has a role of holding a gap between display panel 130 and antenna 250 to insure performance of antenna 250, it is possible to allow first rib 310 to have a characteristic as an antenna. Also, although a large radiation element is necessary to insure a wideband receiving characteristic, it is possible to allow first rib 310 to function as a part of a radiation element. Accordingly, information processing apparatus 100 can be configured such that an antenna operating in two or more communication bands is disposed in a space conserving manner.

Also, according to the exemplary embodiment, the antenna element includes first antenna element 420 electrically connected to a feeding point, and second antenna element 430 electrically connected to a ground point, and first rib 310 is conducted to second antenna element 430.

With this configuration, since second antenna element 430 connected to a ground potential is connected to a ground potential of information processing apparatus 100, the ground potential of antenna 250 tends to easily become electrically equal to the ground potential of information processing apparatus 100. In other words, the ground of antenna 250 is enhanced. As a result, characteristics of antenna 250 are improved.

Also, according to the exemplary embodiment, second antenna element 430 is held by being fixed to first rib 310 with a conductive fixing member. This makes it possible not only to physically firmly fix antenna 250 to information processing apparatus 100, but also to further enhance the ground of antenna 250.

Also, according to the exemplary embodiment, network interface 240 processes signals used for communications in at least two frequency bands, a first frequency band and a second frequency band higher in frequency than the first frequency band, and one of first rib 310 and the antenna element causes a smaller resonance in a case of performing communication in the second frequency band than in a case of performing communication in the first frequency band. This makes it possible to provide an information processing apparatus having a superior receiving characteristic in a plurality of frequency bands, by adjusting the sum of the height of first rib 310 and the length of the antenna element for the first frequency band, and adjusting one of the height of first rib 310 and the length of the antenna element for the second frequency band. Accordingly, it is possible to easily provide an information processing apparatus having a superior receiving characteristic.

Also, according to the exemplary embodiment, the antenna element causes a smaller resonance in a case of performing communication in the second frequency band than in a case of performing communication in the first frequency band. This makes it possible, in a high frequency band in which electromagnetic waves possibly affect on human body are used, to cause resonance of first rib 310, which is disposed farther from a human body than the antenna element is. Accordingly, such possibility is reduced that an electromagnetic wave affecting on human body is radiated near a human body in a high frequency band.

Also, according to the exemplary embodiment, display panel 130 is held by being sandwiched between a front cover and a rear cover, and first rib 310 is formed integrally with the front cover, the rear cover or the display panel. This eliminates the necessity of forming first rib 310 by another member.

What is claimed is:

1. An information processing apparatus comprising:

a network interface for processing signals used for communications in a plurality of frequency bands;

a display panel having a main surface for displaying an image, a rear surface opposite to the main surface, and a side surface defining a thickness between the main surface and the rear surface;

a housing having a front cover and a rear cover, the front cover being disposed at a side of the main surface and the rear cover being disposed at a side of the rear surface;

an antenna connected to the network interface and having conductive antenna elements, the antenna elements including a first antenna element and a second antenna element; and a conductive rib electrically connected to the second antenna element, and holding the antenna with a predetermined gap between the antenna and the side surface of the display panel, wherein the conductive rib is not electrically connected to the first antenna element, the network interface processes the signals by resonance of a part of the first antenna element and a part of the conductive rib, the display panel is sandwiched between the front cover and the rear cover, and the conductive rib and at least one of the front cover and the rear cover are molded integrally.

2. The information processing apparatus according to claim 1, wherein the first antenna element is electrically connected to a feeding point; and the second antenna element is electrically connected to a ground point.

3. The information processing apparatus according to claim 2, wherein the second antenna element is held by being fixed to the rib with a conductive fixing member.

4. The information processing apparatus according to claim 1, wherein the network interface processes signals used for communications in at least two frequency bands including a first frequency band and a second frequency band higher in frequency than the first frequency band, and wherein one of the rib and the antenna elements causes a smaller resonance in a case of performing communication in the second frequency band than in a case of performing communication in the first frequency band.

5. The information processing apparatus according to claim 4, wherein one of the antenna elements causes a smaller resonance in a case of performing communication in the second frequency band than in a case of performing communication in the first frequency band.

6. An information processing apparatus comprising:

a network interface for processing signals used for communications in a plurality of frequency bands;

a display panel having a main surface for displaying an image, a rear surface opposite to the main surface, and a side surface defining a thickness between the main surface and the rear surface;

a housing having a front cover and a rear cover, the front cover being disposed at a side of the main surface and the rear cover being disposed at a side of the rear surface;

an antenna connected to the network interface and having an antenna element; and a conductive rib electrically connected to the antenna element, and holding the antenna with a predetermined gap between the antenna and the side surface of the display panel, wherein the network interface processes the signals by resonance of a part of the antenna element and a part of the conductive rib, the conductive rib has a height corresponding to a dimension of the predetermined gap in a height direction of the conductive rib, the display panel is held by being sandwiched between the front cover and the rear cover, and the conductive rib and at least one of the front cover and the rear cover are molded integrally.

* * * * *